US006922203B2

(12) United States Patent
Giere et al.

(10) Patent No.: US 6,922,203 B2
(45) Date of Patent: Jul. 26, 2005

(54) BARRIER/ORIFICE DESIGN FOR IMPROVED PRINTHEAD PERFORMANCE

(75) Inventors: Matthew D. Giere, San Diego, CA (US); Clayton L. Holstun, San Marcos, CA (US); James A. Feinn, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/876,506

(22) Filed: Jun. 6, 2001

(65) Prior Publication Data

US 2003/0001913 A1 Jan. 2, 2003

(51) Int. Cl.[7] ..... B41J 2/045
(52) U.S. Cl. ..... 346/65; 347/47; 347/56
(58) Field of Search ..... 347/65, 48, 12, 347/87, 40, 63, 98, 47, 56

(56) References Cited

U.S. PATENT DOCUMENTS

| | | | | | |
|---|---|---|---|---|---|
| 4,746,935 | A | * | 5/1988 | Allen | 347/98 |
| 5,648,805 | A | | 7/1997 | Keefe et al. | 347/65 |
| 5,648,806 | A | | 7/1997 | Steinfield et al. | 347/87 |
| 5,984,464 | A | * | 11/1999 | Steinfield et al. | 347/87 |
| 6,053,599 | A | * | 4/2000 | Maeda | 347/65 |
| 6,162,589 | A | | 12/2000 | Chen et al. | 430/320 |
| 6,280,021 | B1 | * | 8/2001 | Wu et al. | 347/65 |
| 6,286,941 | B1 | * | 9/2001 | Courian et al. | 347/65 |
| 6,582,062 | B1 | * | 6/2003 | Childers et al. | 347/59 |

FOREIGN PATENT DOCUMENTS

| | | |
|---|---|---|
| EP | 0440490 B1 | 12/1995 |
| EP | 0897804 A2 | 2/1999 |
| EP | 0913257 A2 | 5/1999 |
| EP | 1080898 A2 | 3/2001 |
| JP | 06079873 A | 3/1994 |

OTHER PUBLICATIONS

European Search Report dated Sep. 13, 2002 re European Patent Application 02253577.7–2304/.
Patent Abstracts of Japan, vol. 018, No. 335, (M–1627) Jun. 24, 1994 (Fuji Xerox Co. Ltd.).

* cited by examiner

*Primary Examiner*—Stephen D. Meier
*Assistant Examiner*—Lam S. Nguyen

(57) ABSTRACT

A fluid ejecting printhead including a substrate having a surface, and a columnar group of drop generators formed on the surface that are arranged into subgroups, each subgroup being fluidically isolated from other subgroups on the surface. Firing pulses are provided to the drop generators such that no two drop generators in the same subgroup are activated in sequence.

39 Claims, 9 Drawing Sheets

BARRIER/ORIFICE DESIGN FOR IMPROVED PRINTHEAD PERFORMANCE

CROSS-REFERENCE TO RELATED APPLICATION

This application is related to application Ser. No. 09/876,470, filed Jun. 6, 2001, PRINTHEAD WITH HIGH NOZZLE PACKING DENSITY, J. Feinn et al.

TECHNICAL FIELD OF THE DISCLOSURE

This invention relates to printheads, and more particularly to barrier/orifice structure designs for improved performance.

BACKGROUND OF THE DISCLOSURE

An exemplary application for the techniques disclosed herein is that of ink-jet printing. By way of example, thermal inkjet printers operate by expelling a small volume of ink through a plurality of small nozzles or orifices in a surface held in proximity to a medium upon which marks or printing is to be placed. These nozzles are arranged in a fashion in the surface such that the expulsion of a droplet of ink from a determined number of nozzles relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of nozzles so that selected firing of the orifices can produce a multicolored image by the inkjet printer.

Expulsion of the ink droplet in a conventional thermal inkjet printer is a result of rapid thermal heating of the ink to a temperature which exceeds the boiling point of the ink solvent and creates a vapor phase bubble of ink. Rapid heating of the ink can be achieved by passing a square pulse of electric current through a resistor, typically for 0.5 to 5 microseconds. Each nozzle is coupled to a small unique ink firing chamber filled with ink and having the individually addressable heating element resistor thermally coupled to the ink. As the bubble nucleates and expands, it displaces a volume of ink which is forced out of the nozzle and deposited on the medium. The bubble then collapses and the displaced volume of ink is replenished from a larger ink reservoir by way of ink feed channels.

After the deactivation of the heater resistor and the expulsion of ink from the firing chamber, ink flows back into the firing chamber to fill the volume vacated by the ink which was expelled. It is desirable to have the ink refill the chamber as quickly as possible, thereby enabling very rapid firing of the nozzles of the printhead. The ink flow into the chamber is through an entrance channel.

SUMMARY OF THE DISCLOSURE

A fluid ejecting printhead is described, and in an exemplary embodiment includes a substrate having a surface, and a columnar group of drop generators formed on the surface that are arranged into subgroups, each subgroup being fluidically isolated from other subgroups on the surface. The printhead further includes printhead electronics that provide firing pulses to the drop generators such that no two drop generators in the same subgroup are activated simultaneously or preferably in sequence.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
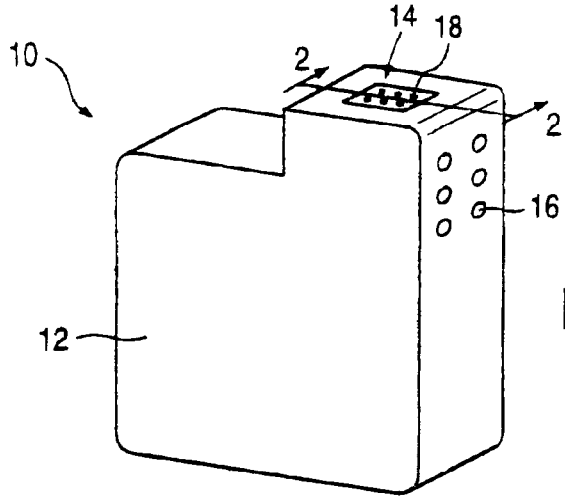
FIG. 1 is a isometric view of one embodiment of a print cartridge which may incorporate any one of the printheads described herein.

FIG. 1 is a perspective view of one type of inkjet print cartridge 10 which may incorporate the printhead structures of the present invention. The print cartridge 10 of FIG. 1 is the type that contains a substantial quantity of ink within its body 12, but another suitable print cartridge may be a type that receives ink from an external ink supply either mounted on the printhead or connected to the printhead via a tube.

The ink is supplied to a printhead 14. Printhead 14 channels the ink into ink ejection chambers, each chamber containing an ink ejection element. Electrical signals are provided to contacts 16 to individually energize the ink ejection elements to eject a droplet of ink through an associated nozzle 18. The structure and operation of conventional print cartridges are very well known.

In an exemplary application, the invention relates to the printhead portion of a print cartridge, or a printhead that can be permanently installed in a printer, and, thus, is independent of the ink delivery system that provides ink to the printhead. The invention is also independent of the particular printer into which the printhead is incorporated.

While an exemplary application for this invention is in printing systems, it is to be understood that the invention is not limited to printing systems, as it can find utility in non-printing applications as well, and particularly applications utilizing the ejecting of precisely controlled droplets of fluid, e.g. medical applications for ejecting droplets of medicine.

Figure 2:
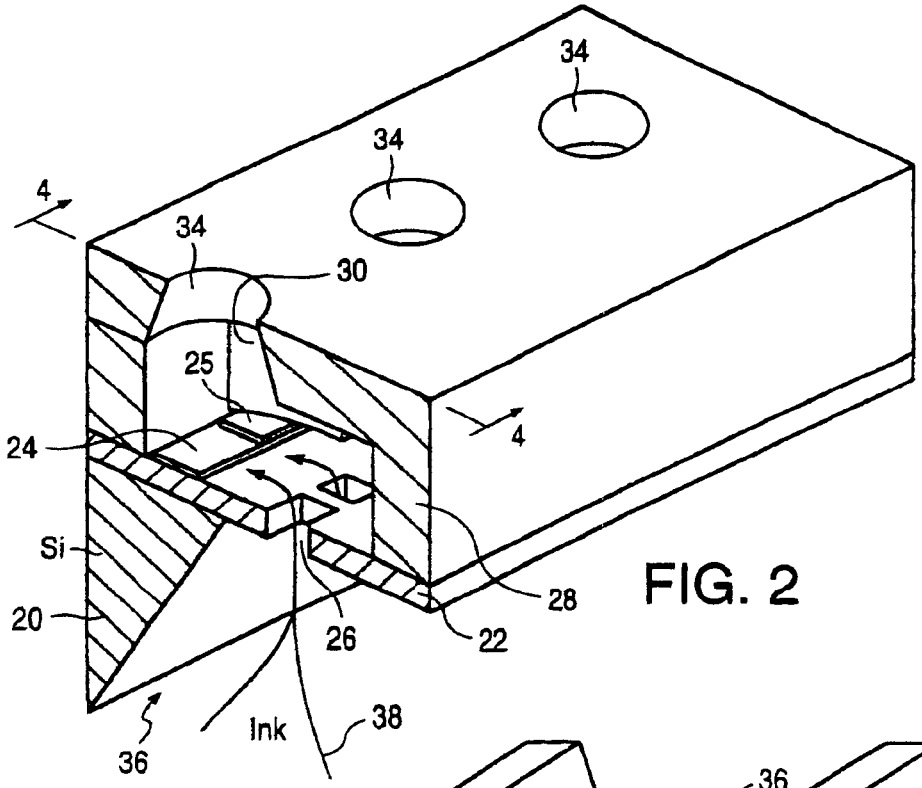
FIG. 2 is an isometric cutaway view of a portion of one embodiment of a printhead in accordance with aspects of this invention.

FIG. 2 is a cross-sectional view of a portion of the printhead of FIG. 1 taken along line 2—2 in FIG. 1. A printhead typically has many nozzles, e.g. 300 or more nozzles and associated ink ejection chambers. Many printheads can be formed on a single silicon wafer and then separated from one another using conventional techniques.

In FIG. 2, a silicon substrate 20 has formed on it various thin film layers 22, sometimes hereinafter referred to as a "membrane." The thin film layers 22 include a resistive layer for forming resistors 24. Other thin film layers perform various functions, such as providing electrical insulation from the substrate 20, providing a thermally conductive path from the heater resistor elements to the substrate 20, and providing electrical conductors to the resistor elements. One electrical conductor 25 is shown leading to one end of a resistor 24. A similar conductor leads to the other end of the resistor 24. In an actual embodiment, the resistors and conductors in a chamber would be obscured by overlying layers.

Ink feed holes 26 are formed completely through the thin film layers 22.

An orifice layer 28 is deposited over the surface of the thin film layers 22 and etched to form ink ejection chambers 30, one chamber per resistor 24. Nozzles 34 may be formed by laser ablation using a mask and conventional photolithography techniques.

The silicon substrate 20 is etched to form a trench 36 extending along the length of the row of ink feed holes 26 so that ink 38 from an ink reservoir may enter the ink feed holes 26 for supplying ink to the ink ejection chambers 30.

In one exemplary embodiment, each printhead is approximately one-half inch long and contains four offset rows of nozzles, each row containing 304 nozzles for a total of 1216 nozzles per printhead. The nozzles in each row have a pitch of 600 dpi, and the rows are staggered to provide a printing resolution, using both rows, of 2400 dpi. The printhead can thus print at a single pass resolution of 2400 dots per inch (dpi) along the direction of the nozzle rows or print at a greater resolution in multiple passes. Greater resolutions may also be printed along the scan direction of the printhead.

In operation, an electrical signal is provided to heater resistor 24, which vaporizes a portion of the ink to form a bubble within an ink ejection chamber 30. The bubble propels an ink droplet through an associated nozzle 34 onto a medium. The ink ejection chamber is then re-filled by capillary action.

Figure 3:
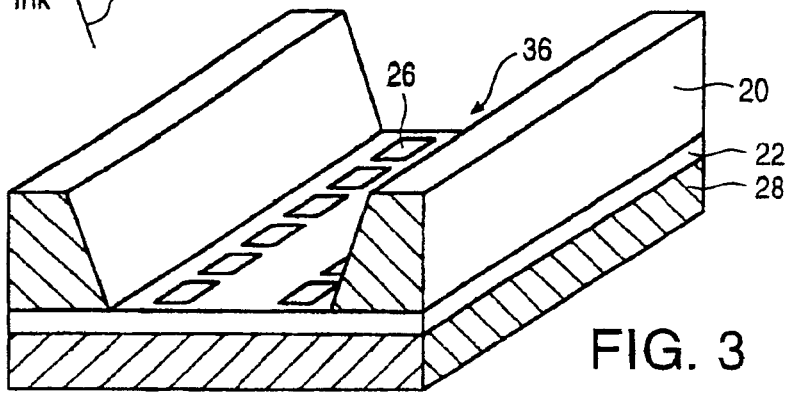
FIG. 3 is an isometric view of the underside of the printhead shown in FIG. 2.

FIG. 3 is a perspective view of the underside of the printhead of FIG. 2 showing trench 36 and ink feed holes 26. In the particular embodiment of FIG. 3, a single trench 36 provides access to two rows of ink feed holes 26.

In one embodiment, the size of each ink feed hole 26 is smaller than the size of a nozzle 34 so that particles in the ink will be filtered by the ink feed holes 26 and will not clog a nozzle 34. The clogging of an ink feed hole 26 will have little effect on the refill speed of a chamber 30 since there are multiple ink feed holes 26 supplying ink to each chamber 30. In one embodiment, there are more ink feed holes 26 than ink ejection chambers 30.

Figure 4:
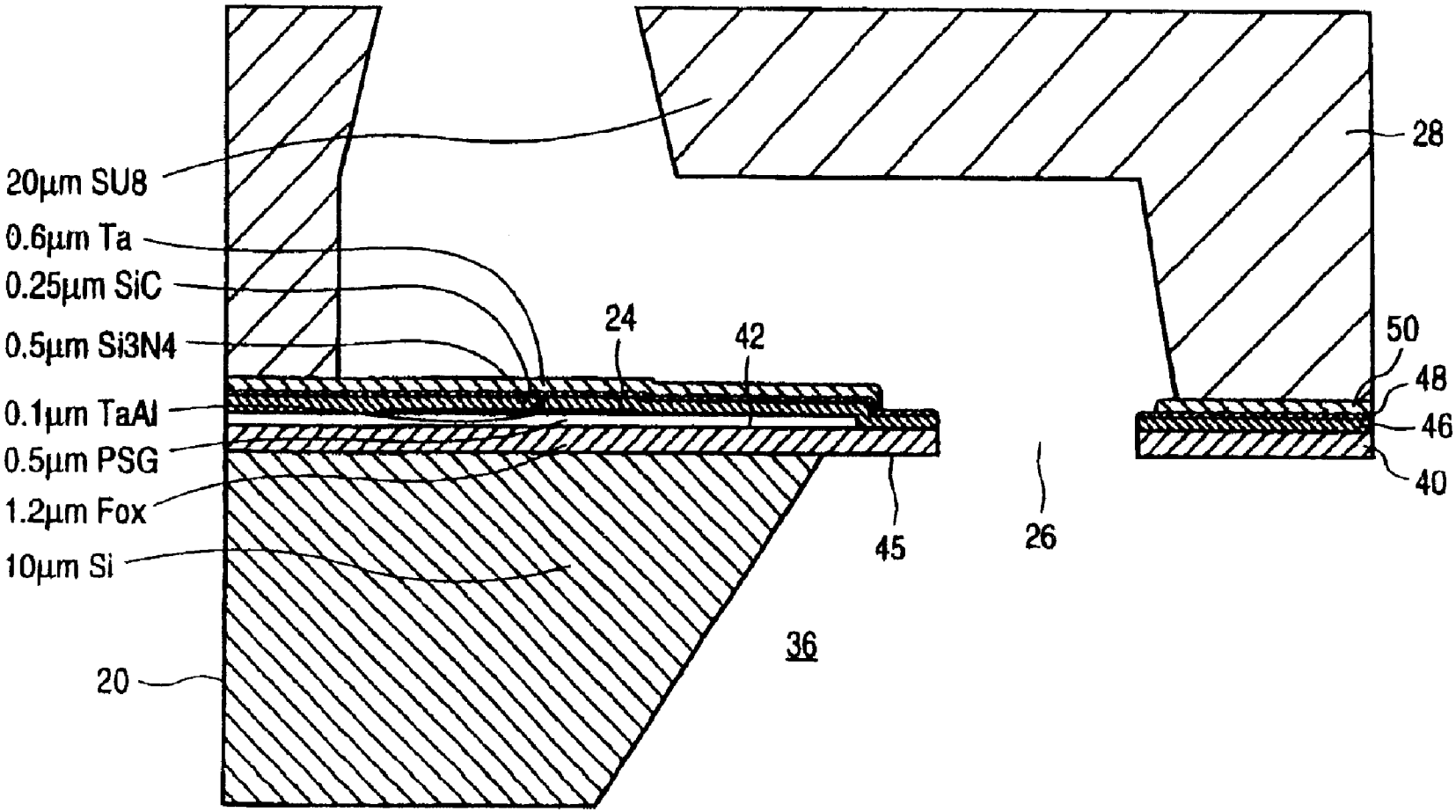
FIG. 4 is a cross-sectional view taken along line 4—4 of FIG. 2.

FIG. 4 is a cross-sectional view along line 4—4 of FIG. 2. FIG. 4 shows the individual thin film layers. In the particular embodiment of FIG. 4, the portion of the silicon substrate 20 shown is about 10 microns thick.

A field oxide layer 40, having a thickness of 1.2 microns, is formed over silicon substrate 20 using conventional techniques. A phosphosilicate glass (PSG) layer 42, having a thickness of 0.5 microns, is then applied over the layer of oxide 40.

A boron PSG or boron TEOS (BTEOS) layer may be used instead of layer 42 but etched in a manner similar to the etching of layer 42.

A resistive layer of, for example, tantalum aluminum (TaAl), having a thickness of 0.1 microns, is then formed over the PSG layer 42. Other known resistive layers can also be used. The resistive layer, when etched, forms resistors 24. The PSG and oxide layers, 42 and 40, provide electrical insulation between the resistors 24 and substrate 20, provide an etch stop when etching substrate 20, and provide a mechanical support for the overhang portion 45. The PSG and oxide layers also insulate polysilicon gates of transistors (not shown) used to couple energization signals to the resistors 24.

In one type of printhead, it is difficult to perfectly align the backside mask (for forming trench 36) with the ink feed holes 26. Thus, the manufacturing process is designed to provide a variable overhang portion 45 rather than risk having the substrate 20 interfere with the ink feed holes 26.

Not shown in FIG. 4, but shown in FIG. 2, is a patterned metal layer, such as an aluminum-copper alloy, overlying the resistive layer for providing an electrical connection to the resistors. Traces are etched into the AlCu and TaAl to define a first resistor dimension (e.g., a width). A second resistor dimension (e.g., a length) is defined by etching the AlCu layer to cause a resistive portion to be contacted by AlCu traces at two ends. This technique of forming resistors and electrical conductors is well known in the art.

Over the resistors 24 and AlCu metal layer is formed a silicon nitride ($Si_3N_4$) layer 46, having a thickness of 0.5 microns. This layer provides insulation and passivation. Prior to the nitride layer 46 being deposited, the PSG layer 42 is etched to pull back the PSG layer 42 from the ink feed hole 26 so as not to be in contact with any ink. This is important because the PSG layer 42 is vulnerable to certain inks and the etchant used to form trench 36.

Etching back a layer to protect the layer from ink may also apply to the polysilicon and metal layers in the printhead.

Over the nitride layer 46 is formed a layer 48 of silicon carbide (SiC), having a thickness of 0.25 microns, to provide additional insulation and passivation. The nitride layer 46 and carbide layer 48 now protect the PSG layer 42 from the ink and etchant. Other dielectric layers may be used instead of nitride and carbide.

The carbide layer 48 and nitride layer 46 are etched to expose portions of the AlCu traces for contact to subsequently formed ground lines (out of the field of FIG. 4).

On top of the carbide layer 48 is formed an adhesive layer 50 of tantalum (Ta), having a thickness of 0.6 microns. The tantalum also functions as a bubble cavitation barrier over the resistor elements. This layer 50 contacts the AlCu conductive traces through the openings in the nitride/carbide layers.

Gold (not shown) is deposited over the tantalum layer 50 and etched to form ground lines electrically connected to certain ones of the AlCu traces. Such conductors may be conventional.

The AlCu and gold conductors may be coupled to transistors formed on the substrate surface. Such transistors are described in U.S. Pat. No. 5,648,806. The conductors may terminate at electrodes along edges of the substrate 20.

A flexible circuit (not shown) has conductors which are bonded to the electrodes on the substrate 20 and terminate in contact pads 16 (FIG. 1) for electrical connection to the printer.

The ink feed holes 26 are formed by etching, e.g., plasma etching, through the thin film layers. In one embodiment, a single feed hole mask is used. In another embodiment, several masking and etching steps are used as the various thin film layers are formed.

An advantage is that the ink feed holes can be formed by a thin film patterning process, providing the capability for forming small and very accurately placed feed holes. This is important for precisely tuning the hydraulic diameter of the feed holes as well as the distance from the feed holes to the associated resistors. In contrast, forming ink feed holes by etching through silicon is not as accurate.

The orifice layer 28 is then deposited and formed, followed by the etching of the trench 36. In another embodiment, the trench etch is conducted before the orifice layer fabrication. In one embodiment, the orifice layer 28 may be fabricated using a spun-on epoxy called SU8, marketed by Micro-Chem, Newton, Mass. Exemplary techniques for fabricating the barrier/orifice layer 28 using SU8 or other polymers are described in U.S. Pat. No. 6,162,589. The orifice layer in one embodiment is about 20 microns. In another embodiment, the layer 28 can be formed of two separate layers, i.e. a barrier layer such as a dry film photoresist barrier layer, and a metal orifice layer, such as a nickel/gold orifice plate, formed on an outer surface of the barrier layer. Other embodiments of the barrier/orifice layer 28 can also be employed.

A backside metal may be deposited if necessary to better conduct heat from substrate 20 to the ink.

Representative dimensions of the elements for an exemplary embodiment may be as follows: ink feed holes 26 are 10 microns×20 microns; ink ejection chambers 30 are 20 microns×40 microns; nozzles 34 have a diameter of 16 microns; heater resistors 24 are 15 microns×15 microns; and manifold 32 has a width of about 20 microns. The dimensions will vary depending on the ink used, the operating temperature, the printing speed, the desired resolution, and other factors.

It is to be understood that the printhead of FIGS. 1–4 is an exemplary printhead, but that the invention can be employed with other types of printheads, or using parameters or materials other than those described above regarding FIGS. 1–4.

Figure 5:
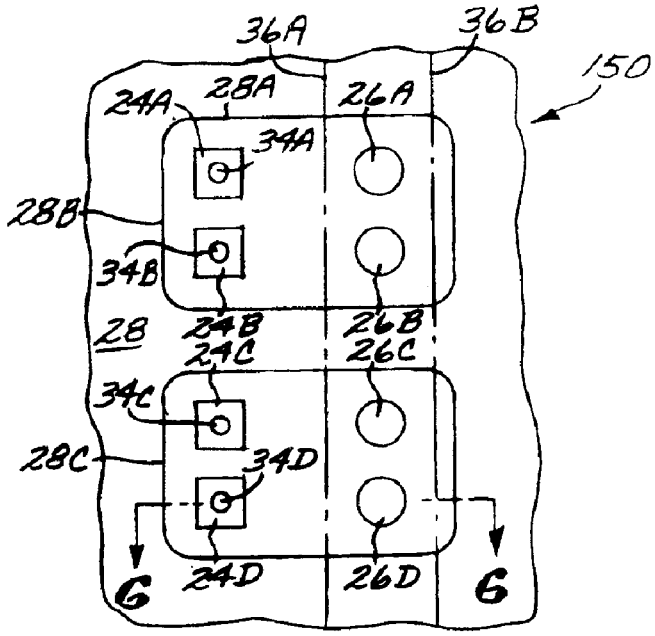
FIG. 5 is a diagrammatic view of a portion of the printhead of FIG. 1, illustrating an aspect of the invention.

FIG. 5 is a schematic top view of a portion of a printhead, illustrating an aspect of the invention. According to this aspect of the invention, groups of drop generators, each with nozzles, (in this example, pairs of drop generators and nozzles) share ink paths, but are fluidically isolated on the top surface of the substrate from the rest of the drop generators in the column using the barrier/orifice material 28. Thus, nozzles 34A and 34B are grouped into a first sub-group, which share ink feed holes 26A and 26B. Similarly, nozzles 34C and 34D are grouped into a second sub-group, which share ink feed holes 26C and 26D. The grouping is accomplished in an exemplary embodiment by forming a subsurface cavity in the barrier/orifice layer 28 adjacent the thin film layer 22 so that the sidewall defining the cavity encompasses the grouped nozzles and shared ink feed holes. Thus, sidewall 28B formed in the barrier layer 28 has a perimeter which extends around the nozzles and ink feed holes of the first subgroup, and sidewall 28C formed in the barrier layer has a perimeter which extends around the nozzles and ink feed holes of the second subgroup.

Figure 6:
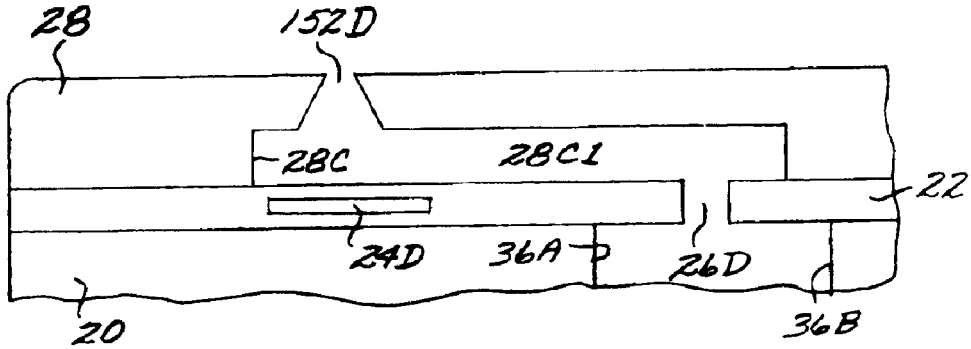
FIG. 6 is a diagrammatic cross-sectional view taken along line 6—6 of FIG. 5.

FIG. 6 is a diagrammatic cross-sectional view taken along line 6—6 of FIG. 5, and further illustrates the sub-surface cavity 28C1 forming the second subgroup. The nozzles of each sub-group are fluidically isolated from nozzles of the other sub-groups on the top of the substrate 20, yet are commonly connected to the feed slot 36 on the bottom of the substrate.

Figure 7:
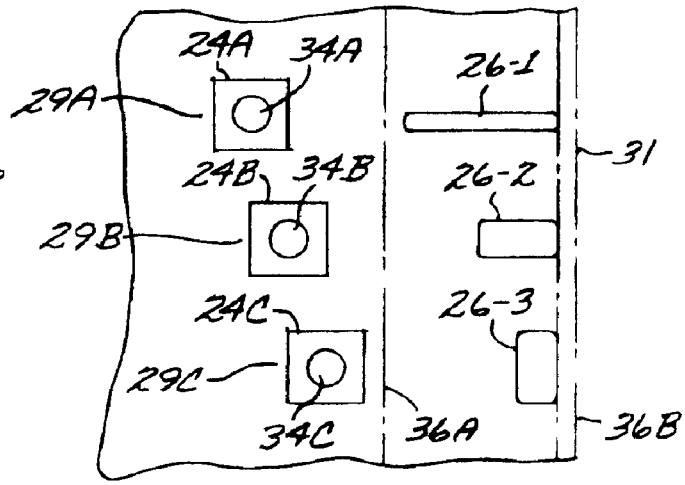
FIG. 7 is a simplified schematic diagram illustrating another aspect of the invention, in a diagrammatic top view of a portion of the printhead.

FIG. 7 is a simplified schematic diagram illustrating another aspect. FIG. 7, a diagrammatic top view of a portion of a printhead, shows a columnar group of drop generators formed on the substrate, with each drop generator comprising a nozzle and a resistor. In this simplified diagram, there are three drop generators 29A–29C, respectively comprising nozzle 24A and resistor 34A, nozzle 24B and resistor 34B, and nozzle 24C and resistor 34C. For this aspect, the drop generators can be grouped into subgroups as described above regarding FIGS. 5–6 to provide fluidic isolation from other subgroups, or not grouped into subgroups, depending on the application. It will be seen that the drop generators in the columnar group are staggered with respect to a vertical axis, and have a varying distance from the inside edge 36A of the ink feed slot formed in the substrate. Thus, for this example, drop generator 29A is located furthest away from the inside edge 36A, and drop generator 29C is located the closest to the inside edge. These varying distances can create differences in ink flow from the corresponding ink feed openings to the respective drop generators. To help offset the varying distances, the ink feed holes 26 associated with the respective drop generators has varying opening geometry. For the drop generator 29A located the furthest distance from the inside edge of the ink feed slot, the ink feed hole has a relatively longer extent or length in a direction extending from the array axis 31 toward the drop generator. Correspondingly, the ink feed hole 26-3 for drop generator 29C has a relatively shorter length. Yet each of the ink feed holes have substantially the same hydraulic diameter to maintain a substantially constant fluidic pressure drop between the ink feed slot and the ink feed openings. The hydraulic diameter of an opening is defined as the ratio of the cross-sectional area of the opening to its wetted perimeter.

Figure 8:
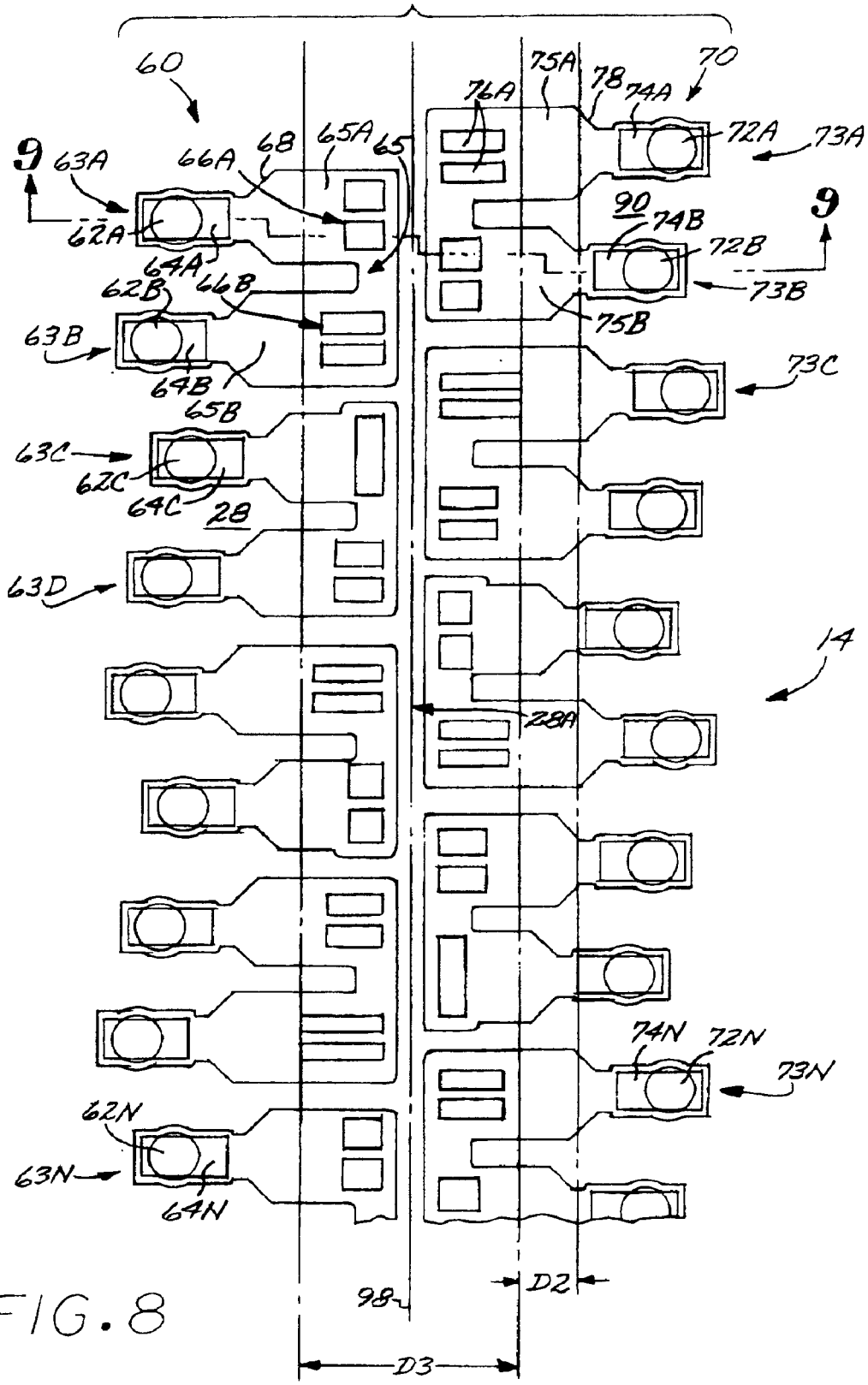
FIG. 8 is a schematic of a representative embodiment of the architecture of an ink jet printhead embodying aspects of this invention.

FIG. 8 is a schematic of a representative embodiment of the architecture of the ink jet printhead 14 embodying aspects of this invention. Two drop generator or nozzle columns 60, 70, with a pitch of 600 nozzles per inch (npi), are formed on the substrate by barrier structure 28 and the membrane of thin film layers 22. The membrane has a center axis 98, and the columns are arranged on opposite sides of the center axis. The printhead 14 can be utilized in a printing system with a scanning printhead carriage which is driven along a scan (Y) axis. The columns 60, 70 are offset relative to each other about the center axis to produce a 1200 npi array of nozzles. The printhead 14 can also be used in other printing systems, e.g. in an essentially fixed, page-wide printhead configuration, wherein the print media is moved relative to the printhead to impart the relative motion between the printhead and the print media.

Cross-talk refers to undesirable fluidic interactions between neighboring nozzles. Certain aspects of the architecture illustrated in FIG. 8 make the avoidance of cross talk challenging. First, the fact that nozzles within a nozzle column are located on a high density pitch such as a 600 npi pitch places the nozzles in closer proximity than in many previous architectures. Associated with this is the fact that the higher nozzle density without a reduction in firing frequency goals creates a need for high ink flux rates and thus refill. Traditionally, the only neighbors considered from a crosstalk point of view are those nozzles that are located in adjacent positions within a nozzle column since nozzle columns are generally separated by sufficient distance that they do not interact fluidically. In the illustrated architecture, neighboring nozzles are found both within the nozzle columns as well as the column located on the opposite side of the feed slot or trench 36. Consequently, cross talk reduction can be considered in two dimensions rather than just one dimension.

To address "within column" proximity, skip patterns are typically built into the fire sequence so that adjacent nozzles are not fired consecutively, thus maximizing the temporal separation of firings. In addition to this temporal improvement, fluidic isolation, usually in the form of peninsulas extending between adjacent nozzles, can be used to further reduce crosstalk. This cross talk reduction come at the cost of refill; it has been shown that there is substantial ink flow along the length of the die. As such, cross talk reduction features reduce the potential for lateral flow, and can potentially slow refill speeds, which will be particularly problematic for high nozzle density designs, e.g. 600 npi or greater.

Thin film membranes are prone to cracking since they are very thin (on the order of 1–2 $\mu$m). Inherent stresses within the thin films, manufacturing stresses, or dropping of the printheads, can initiate cracking. Since the cracks, once formed, can propagate to electrically functional regions of the die, it is desirable that they be kept from forming.

It is also desirable that the printhead architectures be particle tolerant. Particle tolerant architectures (PTA) improve reliability by trapping contaminants while still allowing for ink flow into the firing chambers.

The architecture of FIG. 8 has a number of advantages. In one divergence from tradition, as generally described above with respect to FIGS. 5 and 6, subgroups of drop generator nozzles share ink paths, but are isolated from the rest of the nozzles in the column using the cavities formed in the barrier/orifice material 28. Thus, as illustrated in FIG. 8, column 60 comprises a columnar array of drop generators 63A, 63B, 63C, . . . 63N, and column 70 comprises a columnar array of drop generators 73A, 73B, 73C, . . . 73N. Each drop generator includes a nozzle, a firing chamber and a firing resistor. Drop generators 63A, 63B comprise respective nozzles 62A, 62B and firing chambers 64A, 64B, and, in accordance with an aspect of the invention, are arranged to form a subgroup of drop generator or nozzle subgroup, in this exemplary case, a pair. It is to be understood that, in other embodiments, the drop generators can be grouped in threes, fours or even larger subgroups. Moreover, it is not necessary that all the subgroups be of the same numbers of nozzles.

The exemplary drop generator subgroup, 63A, 63B, is fed by an isolated ink feed path 65 having a path branch 65A which feeds firing chamber 64A, and a path branch 65B which feeds firing chamber 64B. The feed path for each subgroup in a column is fluidically isolated from the feed paths for the other drop generators in the column. A pair of ink feed holes 66A feeds the first path branch 65A, and a pair of ink feed holes 66B feeds the second path branch 65B. The ink feed path is defined by a cavity or opening formed in the barrier structure 28 having a sidewall perimeter 68, and the ink feed holes formed in the thin film layer 22. The barrier opening allows for "sharing" of the ink feed holes 66A, 66B, while isolating the nozzle subgroup 62A, 62B from the ink feed paths of the other nozzles in the column 60.

The grouping and ink path configuration are replicated, in this exemplary embodiment, for the other drop generator nozzles in the column 60, and for the nozzle pairs in the second column 70. Thus, drop generators 73A, 73B of column 70 comprise respectively nozzles 72A, 72B and firing chambers 74A, 74B to form a drop generator or nozzle subgroup. The subgroup is fed by an ink feed path 75 having a path branch 75A which feeds firing chamber 74A, and a path branch 75B which feeds firing chamber 74B. A pair of ink feed holes 76A feeds the first path branch 75A, and a pair of ink feed holes 76B feeds the second path branch 75B. The ink feed path is defined by a cavity having a sidewall perimeter 78 formed in the barrier structure 28, and the ink feed holes formed in the thin film layer 22. The barrier opening allows for "sharing" of the ink feed holes 76A, 76B, while isolating the nozzle pair 72A, 72B from the ink feed paths of the other nozzles in the column 70.

Figure 9:
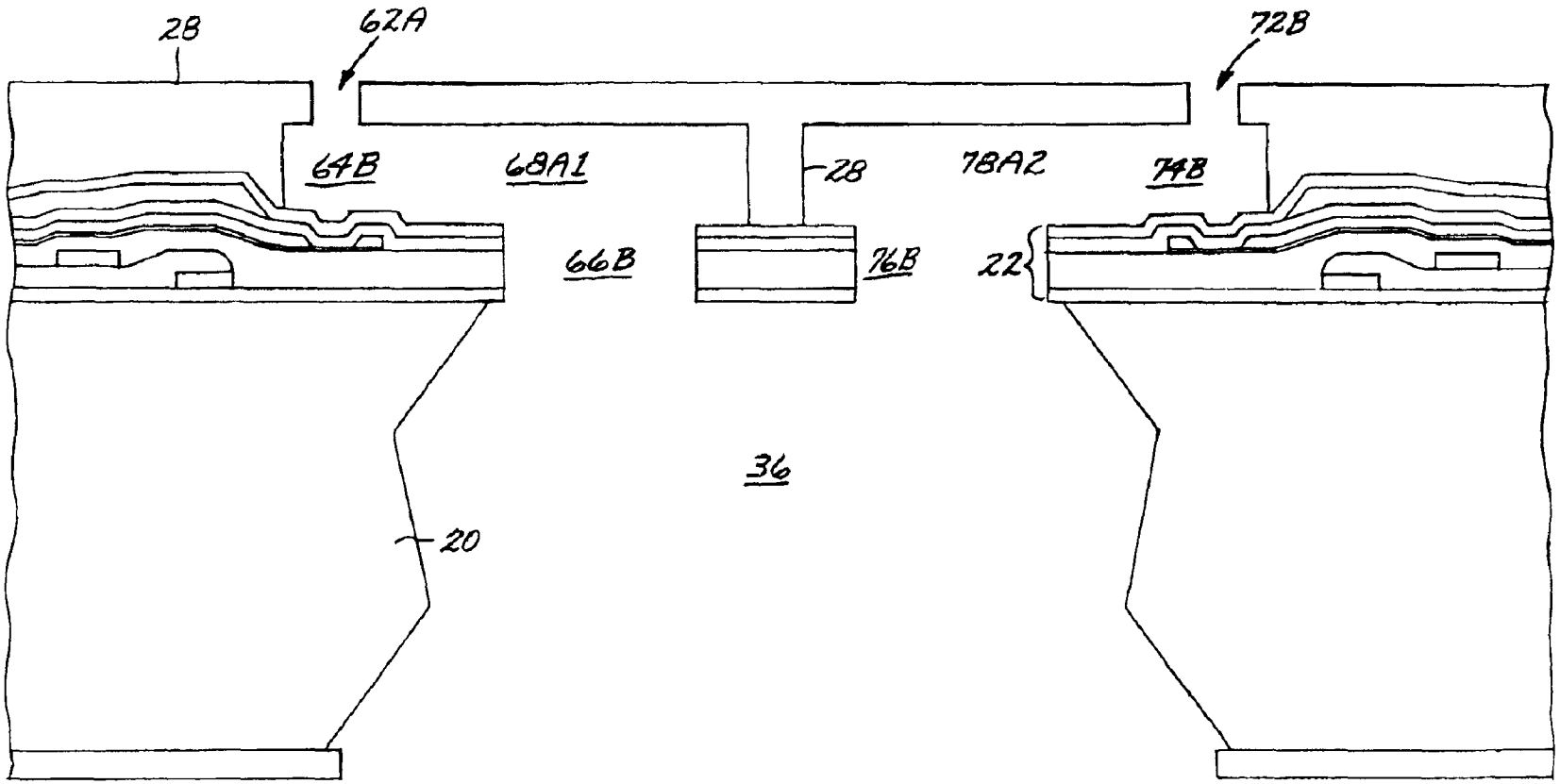
FIG. 9 is a simplified diagrammatic cross-sectional view taken along line 9—9 of FIG. 8.

The barrier structure 28 further defines a center rib portion 28A dividing the two columns of nozzles 60, 70, providing fluidic column isolation and thin film membrane support. FIG. 9 illustrates in a simplified diagrammatic cross-sectional view the center rib portion 28A of the barrier structure 28, and exemplary ink feed holes 66B, 76B formed through the thin film structure 22 to provide fluid communication with the ink feed slot or trench 36. Exemplary nozzles 62A, 72A are shown on opposite sides of the center rib portion, above the respective firing chambers 64B, 74B.

The connection of nozzle ink feed paths provides refill and particle tolerance benefits that would not be realized if singulated nozzles, the ultimate in cross talk reduction, were used. In this exemplary embodiment, the printhead electrical layout is designed such that the printhead is not allowed to fire adjacent nozzles simultaneously. Typically, the nozzle firing order is determined by the on-die drive circuitry. In some thermal ink-jet applications, the die circuitry is designed such that the firing order is programmable. In other applications, the firing order is "hardwired" in the design of the on-die circuitry. In either case, the physical layout of the firing resistors is staggered in the scan axis, to enable vertical line straightness during printing. Alternatively, the printer driver or controller can be configured so as to not allow adjacent nozzles to be fired simultaneously. Since any nozzle is refilling only a small percentage of the time, ink fill holes associated with an isolated firing chamber are only providing ink flux a small percentage of time, and thus are not operating at peak efficiency.

Figure 10:
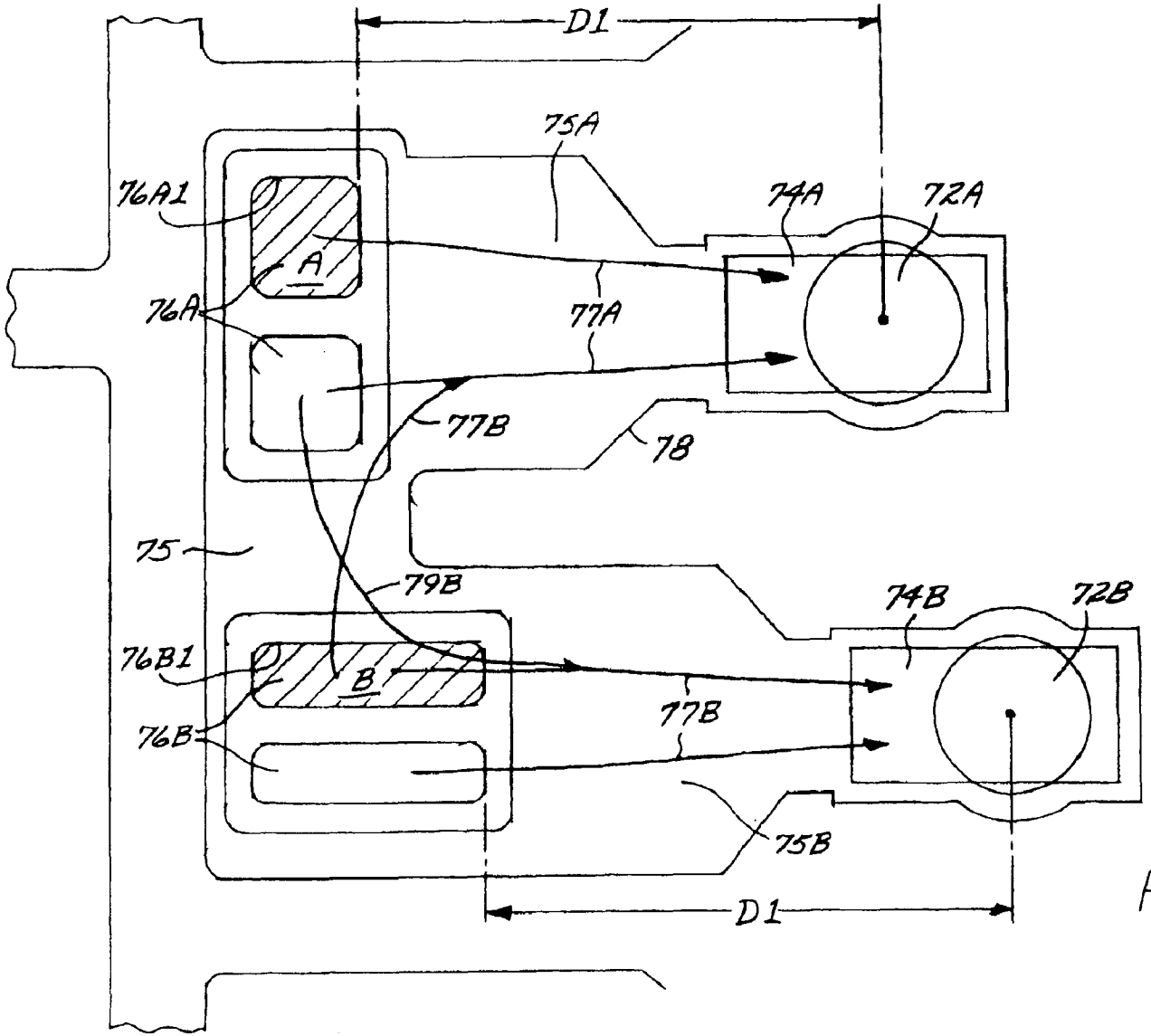
FIG. 10 is a schematic illustration of adjacent nozzle pairs with respective connected ink feed paths.

When nozzle ink feed paths are connected fluidically, a nozzle can refill using ink drawn through the ink feed holes associated with connected nozzles allowing the ink feed holes to be utilized more efficiently and increase refill speeds. This feature is illustrated in FIG. 10, which schematically illustrates nozzle pair 72A, 72B with connected ink feed paths 75A, 75B. When nozzle 72A is fired, ink flows from ink fill holes 76A to the firing chamber 74A, as shown by arrows 77A, and also from the second ink fill hole 76B as shown by arrow 77B. When nozzle 72B is fired, ink flows from ink fill holes 76B to the firing chamber 74B, as shown by arrows 79A, and also from the first ink fill hole 76A as shown by arrow 79B.

Additional benefit comes from the fact that the use of connected nozzles provides a degree of particle tolerance; in the case that the ink feed holes associated with a particular nozzle become blocked, refill can be sustained or supplemented by pulling ink from neighboring ink feed holes, allowing the nozzle to continue operation.

Another feature is the use of a continuous barrier/orifice material feature, provided by rib 28A in this embodiment, down the center axis 98 of the membrane that has the effect of fluidically isolating nozzles on opposite sides of the axis. Beyond fluidic isolation, this center rib feature has the benefit that the continuous span of barrier/orifice material adds strength and stiffness to the membrane comprising the thin film structure 22 and the barrier/orifice layer 28, thereby increasing its robustness to cracking.

The architecture of FIG. 8 can provide several benefits from a manufacturing point of view. During an exemplary barrier/orifice material develop process for a barrier/orifice structure 28 fabricated using a polymer material such as SU8, un-crosslinked barrier/orifice material is removed by a developer fluid with all flow passing through the nozzle bores. As such, processing is simplified by reducing the volume of un-crosslinked barrier/orifice material. Beyond the benefit realized through the reduced volume, there is a configurational benefit as well. Since the developing fluid for the example of the SU8 material is spun on, designs in which all nozzles are connected fluidically allow the developer fluid to flow along the length of the die. This has the effect of allowing the fluid to flow easily to the edges of individual die as well as the edges of the wafer. This has the consequence of increasing the variability of barrier/orifice material features both within a die and across a wafer. By breaking the continuity of nozzle connections along the length of the die, this source of variability is reduced. The manufacturing yield during this exemplary processing to form the barrier/orifice structure 28 can be improved by creating singulated subsets of nozzles. When the firing chambers are all connected, it is more difficult to effectively wash out residue of the material forming the layer 28 from the nozzles that are at the ends of the die.

Another advantage of configuring the nozzles of a column in sub-groups is that of cross talk reduction. Since the only connection between non-grouped nozzles outside a particular grouping is through the ink reservoir, the potential for fluidic interaction with nozzles outside a particular grouping is minimized. Cross talk between nozzles in any particular grouping is minimized by the fact that the skip firing pattern used creates a situation in which nozzles within a subgroup never fire sequentially. The skip firing pattern is described with respect to the schematic printhead diagram of FIG. 11.

Skip patterns are typically built into the fire sequence so that the nozzles within a primitive are not fired consecutively, i.e. to distribute firing within a primitive temporally. In this embodiment, pairs of nozzles are isolated using the barrier/orifice material as shown in FIG. 8. Since the skip pattern is determined a priori, the pairing of resistors is done in a manner that ensures there will be an barrier structure separating consecutively firing chambers.

Figure 11:
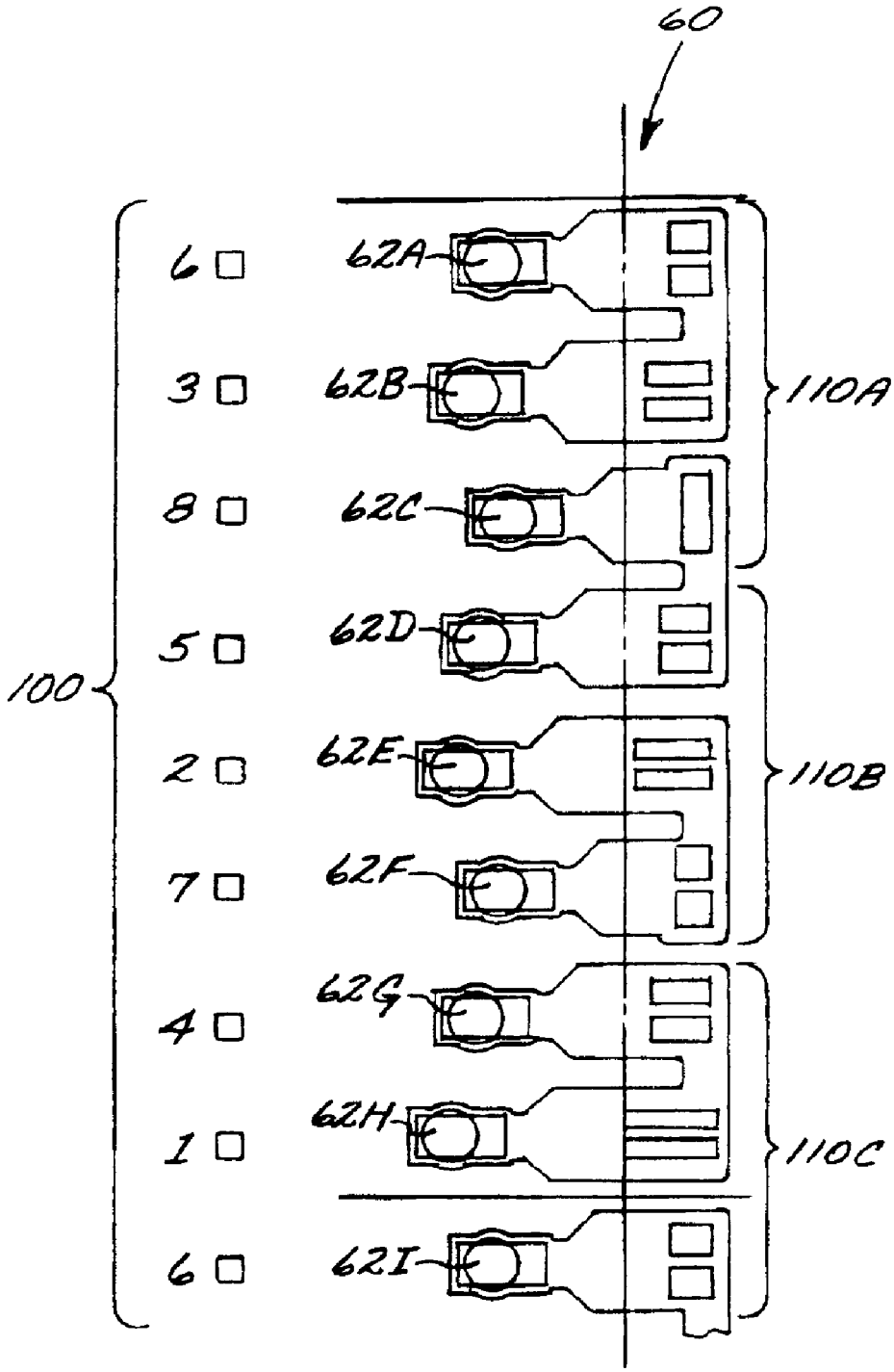
FIG. 11 is a schematic printhead diagram showing a skip firing pattern.

A primitive is a group of nozzles in a given column. FIG. 11 illustrates a primitive 100 comprising eight nozzles 62A–62H, with a corresponding firing sequence 6, 3, 8, 5, 2, 7, 4, 1. The connection of ink feed paths can be optimized beyond the embodiment shown by selecting the number of connected chambers as a function of the stagger pattern. In a "no skip" configuration, i.e. wherein the firing order within a primitive is consecutive (1, 2, 3, 4, . . . ), and adjacent nozzles fire consecutively, an isolated chamber is desirable since immediate neighbors fire sequentially and need fluidic isolation. In a "skip 1" pattern, e.g. a firing order within the primitive of 1, 3, 5, 7, 2, 4, 6, 8, immediate neighbors never fire sequentially. Thus the temporal isolation of the nozzles allows for the connection of nozzle ink feed paths in pairs; since firings of the connected nozzles are separated in time, the potential for cross talk to cause problems is reduced, and the refill and particle tolerance advantages of connected ink feed paths can be captured. By extension of the same principle, refill performance and particle tolerance can be maximized for a design by connecting the ink feed paths of as many nozzles as possible without connecting nozzles that fire sequentially. For the uniform skip patterns typically used:

Max # of connected nozzles=# of nozzles skipped between sequential firings +1.

| # of nozzles skipped | Max # of connected ink feed paths |
|---|---|
| 0 (sequential firing) | 1 (singulated nozzles) |
| 1 | 2 |
| 2 | 3 |
| N | n+ |

In FIG. 11, the firing order of nozzles within a primitive 100 is illustrated. This design utilizes a skip 2 firing pattern. The skip pattern is determined by the electrical layout of the printhead in this embodiment, and so cannot be solely determined by inspection of the barrier/orifice structure. The paired nozzle never fires sequentially with its nozzle pair. FIG. 11 also demonstrates the opportunity of connecting nozzles on the substrate in groups of 3 without loss of temporal separation, wherein group 110A comprises nozzles 62A, 62B, 62C, group 110B comprises nozzles 62D, 62E, 62F, and group 110C comprises nozzles 62G, 62H, 62I. For configurations with a non-uniform skip pattern, the same principle, that of fluidically isolating sequentially firing nozzles while maximizing sharing of ink feed paths, holds but will be complicated by the fact that in some locations it will be necessary to reduce the number of nozzles sharing ink feed paths.

Figure 12:
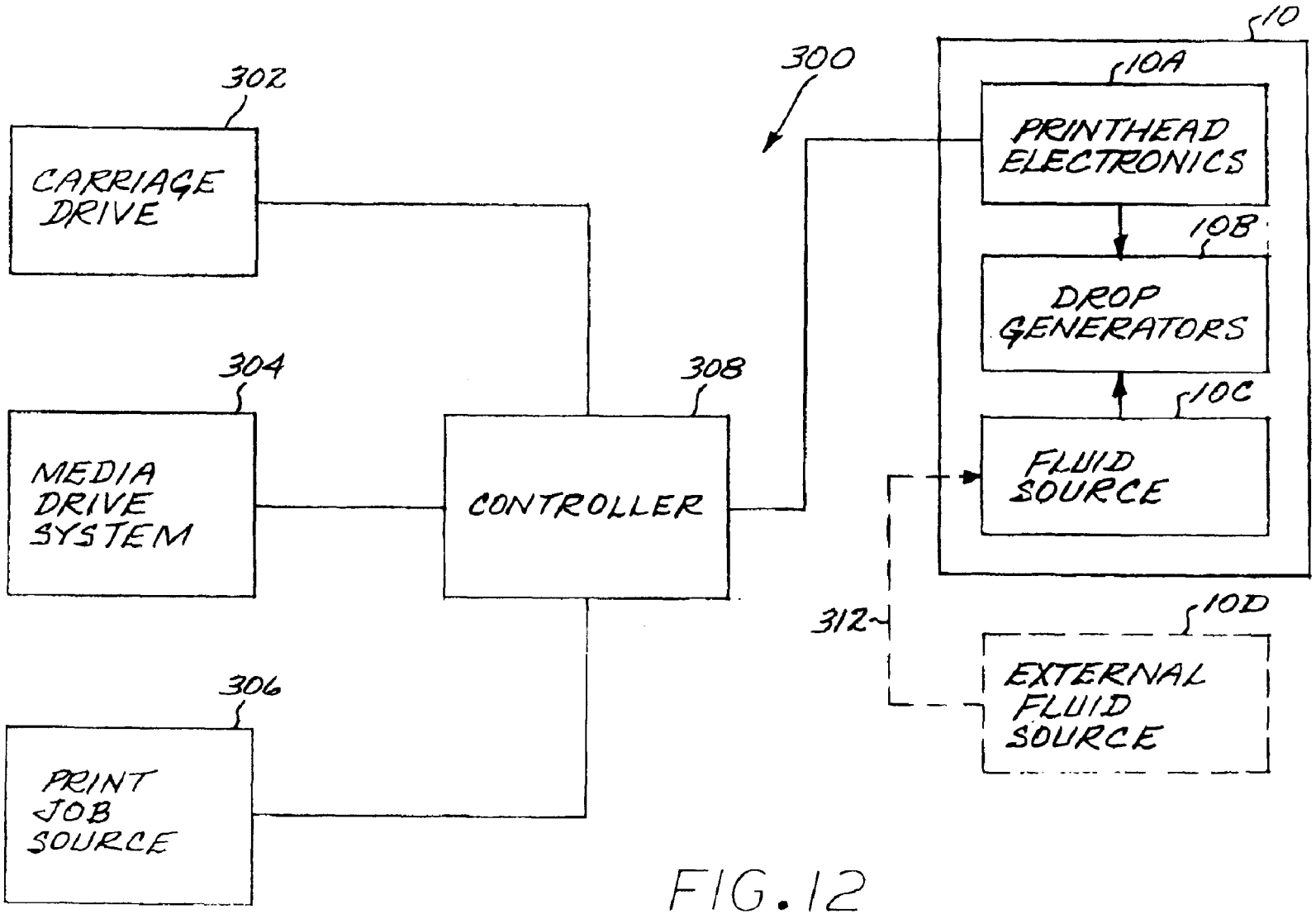
FIG. 12 is a highly simplified schematic diagram illustrating a printing system which can employ one or more of the printheads embodying aspects of the invention.

FIG. 12 is a highly simplified schematic diagram illustrating a printing system 300 which can employ one or more of the printheads 10 embodying aspects of the invention. The system includes a carriage drive 302 for driving a carriage along a carriage scan axis. The carriage has mounted therein the printhead(s) 10. A media drive system 304 positions a print medium relative to a print zone, and can drive the print medium from an input media source to a media output location or tray. A print job source 306, typically external to the printing system, provides job data for printing jobs. A controller 308 is responsive to the print job source and controls the carriage drive and media drive system to print the print jobs. The controller also provides firing signals to the printhead(s) 10 to control operation of the printhead(s). The printhead 10 generally includes a printhead electronics 10A responsive to the firing signals from the controller to energize the drop generator resistors comprising the drop generators 10B. A fluid source 10C provides fluid, e.g. liquid ink, to the drop generators. The fluid source can be a fluid reservoir contained within the printhead 10 housing. An external fluid supply 310 can optionally be provided to replenish the fluid supply 10C through fluid path 312, which can be a fluid conduit connected to the printhead during printing operations, or an intermittent connection used only during refill operations.

In some embodiments, the printhead electronics 10A and the controller 308 together provide the skip firing pattern, and in more typical embodiments, the on-board printhead electronics are configured to provide the skip firing patterns. The printhead electronics 10A is adapted in this exemplary embodiment to implement the skip firing pattern to ensure that firing pulses are provided to the drop generators such that the drop generators in a columnar group (i.e. primitive) are activated one at a time, and such that no two drop generators in the same subgroup, e.g. pair, are activated in sequence. Printhead electronics suitable or readily adaptable for the purpose are described, for example, in pending application Ser. No. 09/798,330, PROGRAMMABLE NOZZLE FIRING ORDER FOR INKJET PRINTHEAD ASSEMBLY, Schloeman et al., filed Mar. 2, 2001; pending application Ser. No. 09/253,377, Barbou et al., SYSTEM AND METHOD FOR CONTROLLING FIRING OPERATIONS OF AN INKJET PRINTHEAD, filed Feb. 19, 1999; U.S. Pat. Nos. 5,648,806; and 5,648,805.

The architecture of FIG. 8 enables 'smart' nozzle cross-talk elimination by combining skip patterns with design of the barrier/orifice layer structure. The architecture provides increased tolerance to blockage of ink feed holes by allowing shared usage. Further, the architecture enables improved manufacturing yields due to membrane stiffening that is provided by the configuration of the barrier/orifice structure. Moreover, the architecture can enable more consistency of features of the barrier/orifice structure within a die and across a wafer.

Nozzles within a primitive are staggered in the scan (Y) axis to improved vertical line straightness, as illustrated in FIG. 8. To promote uniform refill rates for all the chambers in a staggered design, the distance from the leading edge of the ink feed holes to the center of the firing resistor, the cross-sectional area of the ink feed holes, and the wetted perimeter of the ink feed holes should be held as constants for all the firing chambers on the printhead. Distance D1 (FIG. 10) illustrates this distance from the leading edge of an ink feed hole 76A to the center of the firing chamber for nozzle 72A.

In addition, for improved manufacturability and yield, it is desirable to extend the back edge of the ink feed holes towards the center line 98 of the membrane. Further, to ensure the resistor thin films are not "undercut" during the etching of the trench, a spacing D2 (FIG. 8), say 20 μm in this exemplary embodiment, is maintained between the edge of the inner most resistor and the outer most ink feed hole. If the thin films 22 were to be undercut, there would not be silicon under the resistors and the resistors would be prone to overheating. Further, to improve manufacturability, it is desirable to maintain a distance D3 (FIG. 8) of approximately 80 μm or greater from the leading edge of the outermost ink feed hole to the leading edge of the outermost ink feed hole on the opposing side of the membrane (i.e., membrane width). These design objectives can all achieved in the exemplary embodiment depicted in FIG. 8, which implements a distance D3 of 76.1 μm. The minimum distance D3 of 80 μm is chosen for exemplary embodiments in consideration of manufacturability and yield. A typical trench etch process to form the ink feed slot is inherently difficult to control with great precision. A higher minimum distance D3, e.g. 80 μm, provides more margin. Lowering the nominal minimum distance would make the target trench break through opening more difficult to achieve, and if the trench is significantly over-etched, then there may not be any silicon left under the thin film layer.

While thin film membranes are prone to cracking, narrow membranes provide margin against cracking. Tests have shown that membranes of widths under ~100 μm are more reliable than membranes of widths of ~400 μm. An exemplary width of the membrane shown in FIG. 8 is approximately 76 μm. In addition, the barrier rib 28A that runs down the center of the membrane adds strength to the fragile membrane, thereby increasing its robustness to cracking.

The barrier/orifice structure 28 and the thin film layers 22 are designed such that the multiple ink paths can be created through the thin films 22 and the barrier/orifice layer 28 for each drop generator. For the exemplary embodiment of FIG. 8, there are two ink feed holes per firing chamber. In addition, if both of these holes become plugged by contaminants, ink could feed into the firing chamber through neighboring ink feed holes.

The printhead of FIG. 8 can be designed to enable uniform refill rates for staggered, high nozzle packing density designs. This can be accomplished by feed hole cross-sectional area, ink feed hole wetted perimeter, and ink path length parameters which are nominally held as constants for all the firing chambers. These parameters are all shown in FIG. 10. For example, the cross-sectional area of feed hole 76A is the area A within the wetted perimeter 76A1, defined by the wall of the feed hole. The cross-sectional area of feed hole 76B is the area B within the wetted perimeter 76B1, defined by the wall of the feed hole. The area A is equal to the area B, and the length of the entire wetted perimeter 76A1 is equal to the length of the entire wetted perimeter 76B1. Moreover, the distance of the inner edge of both feed holes to the center of the respective firing chambers is equal, i.e. D1.

The printhead architecture can enable high nozzle packing density printheads, which translate to a lower cost/nozzle. Moreover, the printhead architecture enables two levels of particle tolerance, i.e. from the use of multiple ink feed holes per firing chamber, and from singulated groupings of drop generators.

Figure 13:
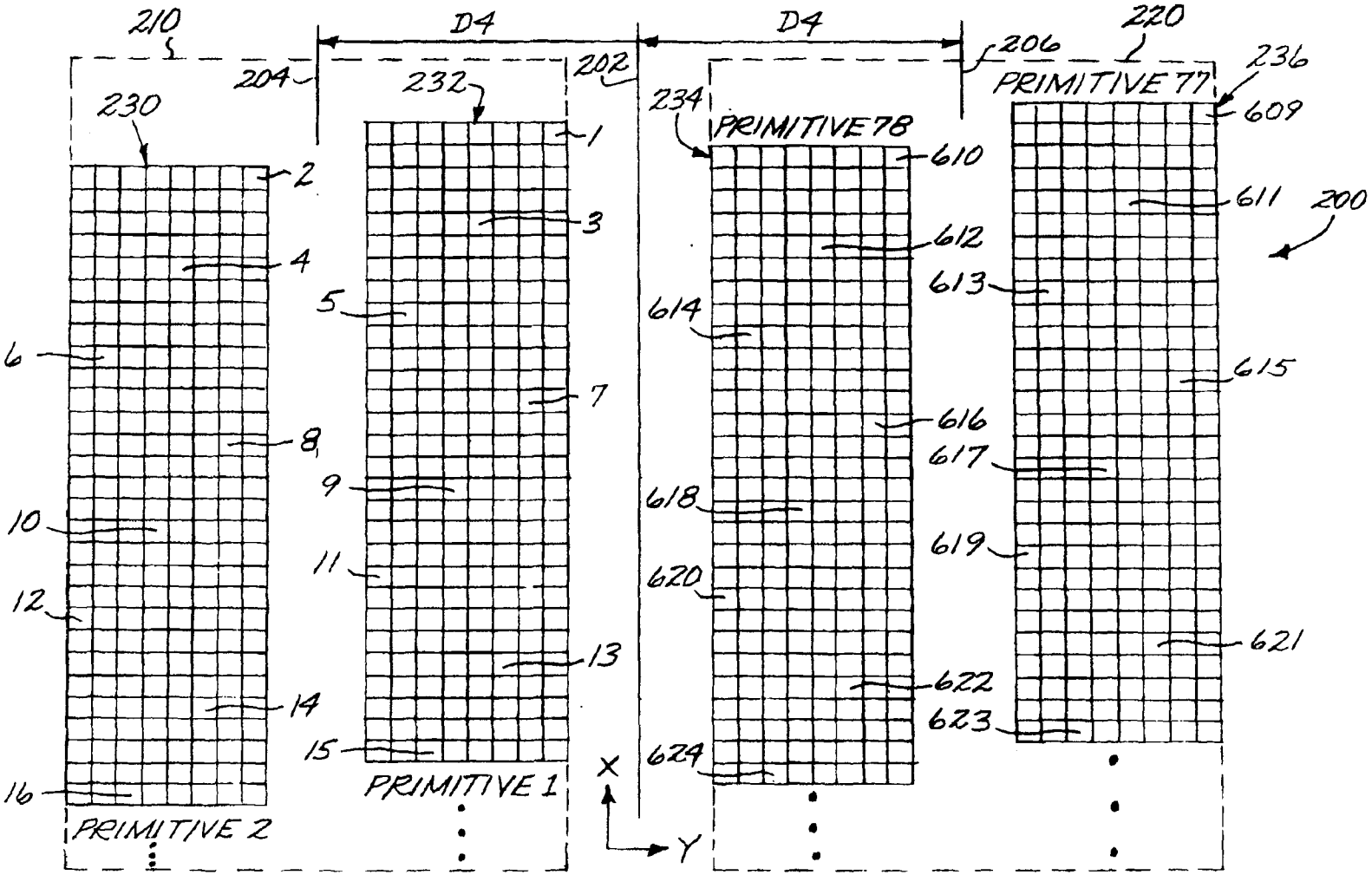
FIG. 13 is a schematic of an alternate printhead architecture to enable a 2400 npi array of nozzles.

A plurality of thin film membranes can be formed on a single die, with nozzle columns on the respective membranes are offset to produce very high nozzle densities. FIG. 13 is a schematic illustration of an alternate printhead architecture of a printhead 200 with two membranes 210, 220 and four nozzle columns 230–236 to enable a 2400 npi array of nozzles. Thus, nozzle columns 230, 232 are formed on membrane 210, and nozzle columns 234, 236 are formed on membrane 220. FIG. 13 illustrates only one nozzle primitive for each column, and so it will be understood that each column will comprise additional nozzle primitives. FIG. 13 is not to scale, but is illustrative of how the four columns are staggered relative to each other and how a skip pattern works. Each column has a width dimension (along the Y axis) of 1/1200 inch in this embodiment, and each primitive has eight staggered nozzles. For example, primitive 2 (column 230) has even numbered nozzles 2, 4, 6, 8, 10, 12, 14, 16, with the Y axis positions of the nozzles within the column staggered as illustrated.

The two membranes 210, 220 are situated about the center axis 202 of the substrate for the printhead, and each is fed with ink through a trench formed in the substrate. Membrane 210 is fed by a trench having a center along line 204, and membrane 220 is fed by a trench having a center along line 206. For this embodiment, the distance (D4) from the center of the die 202 to the centers of each trench (204, 206) is 950 μm. Moreover, the column spacing on each membrane is 169.3 μm. These dimensions of course are for a particular implementation, and will vary depending on application specific parameters and design choices.

Each cell has a dimension in the vertical (X) axis of 1/2400 inch; the cells in the horizontal (Y) axis are not to scale. Also note that the nozzles of column 230 are offset in the X axis by 1/1200 inch relative to the nozzles of column 232, on membrane 210. Similarly the nozzles of column 234 are offset by 1/1200 inch in the X axis relative to the nozzles of column 236, on membrane 220. Further, the nozzles of column 234 are offset in the X direction by 1/2400 inch from the nozzles of column 230 and 232. Thus, the primitive stagger pattern in the X direction produces a nozzle spacing of all nozzles in the four columns of $\frac{1}{2400}$ npi.

In a typical application, the printhead can be mounted on a carriage driven along a scan (Y) axis. The nozzles in each primitive are staggered along the Y axis. The nozzles in each primitive are fired with a skip pattern, as discussed above. For example, a skip 2 pattern can be employed. For a skip 2 pattern, nozzle 2 is fired, nozzles 4 and 6 are skipped, nozzle 8 is fired, nozzles 10 and 12 are skipped, nozzle 14 is fired, nozzles 16 and 2 are skipped, nozzle 4 is fired, nozzles 6 and 8 are skipped, nozzle 10 is fired, nozzles 12 and 14 are skipped, nozzle 16 is fired, nozzles 2 and 4 are skipped, nozzle 6 is fired, nozzles 8 and 10 are skipped, and nozzle 12 is fired. The skip 2 firing order for primitive 2 is 2, 8, 14, 4, 10, 16, 6, 12.

The subgrouping of nozzles within a column as described above with respect to FIGS. 5 and 6, and the considerations of distance from the feed holes to the center of resistors and effective hydraulic diameters of the feed holes, described above with respect to FIG. 7, can be applied to the architecture of FIG. 13, facilitating a printhead with a very high nozzle packing density.

While the embodiments of FIGS. 8 and 13 have employed columnar groups (primitives) in which the printhead electronics fire only one nozzle within each group at a time, aspects of the invention can also be employed in applications where some or all of the nozzles in a given primitive are fired simultaneously.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink jet printhead comprising:

a substrate;

an ink feed slot formed through the substrate;

a thin film layer disposed on a surface of the substrate, the thin film layer defining a plurality of firing resistors, a plurality of ink feed openings formed through the thin film layer to provide respective ink paths through the thin film layer from the ink feed slot;

a barrier/orifice structure disposed on the thin film layer, the structure defining an array of nozzles arranged in a plurality of nozzle columns and an array of firing chambers in correspondence with correspondence with the array of nozzles;

the firing resistors being arranged in correspondence with the firing chambers;

the barrier/orifice structure further comprising a continuous rib portion extending between adjacent first and second ones of the plurality of nozzle columns and over said ink feed slot to fluidically separate the first and second ones of the nozzle columns;

wherein said plurality of ink feed openings are arranged in a first group on a first side of said rib portion for feeding nozzles of the first one of said plurality of columns, and a second group on a second side of said rib portion for feeding nozzles of the second one of said plurality of columns; and wherein the nozzles comprising the array are arranged in subgroups of nozzles, each subgroup comprising at least two nozzles, each subgroup fed with liquid ink through a corresponding ink flow path isolated from other nozzles of the array by the barrier layer/orifice structure, wherein the ink flow path for each nozzle subgroup includes an opening or set of openings through the thin film layer and through the substrate, and wherein each nozzle of a nozzle subgroup supplied with ink via said opening or set of openings.

2. The printhead of claim 1, wherein said ink feed slot is an elongated trench extending along a length of said nozzle columns.

3. An ink jet printhead comprising:

a substrate;

an ink feed slot formed through the substrate;

a thin film layer disposed on a surface of the substrate, the thin film layer defining a plurality of firing resistors, a plurality of ink feed openings formed through the thin film layer to provide respective ink paths through the thin film layer from the ink feed slot;

a barrier/orifice structure disposed on the thin film layer, the structure defining an array of nozzles arranged in a plurality of nozzle columns and an array of firing chambers in correspondence with correspondence with the array of nozzles;

the firing resistors being arranged in correspondence with the firing chambers;

the barrier/orifice structure further comprising a continuous rib portion extending between adjacent first and second ones of the plurality of nozzle columns to fluidically separate the first and second ones of the nozzle columns, said continuous rib portion extending over said ink feed slot;

wherein said plurality of ink feed openings are arranged in a first group on a first side of said rib portion for feeding nozzles of the first one of said plurality of columns, and a second group on a second side of said rib portion for feeding nozzles of the second one of said plurality of columns; and wherein the nozzles comprising each column of the array are arranged in subgroups of nozzles, each subgroup comprising at least two nozzles, each subgroup fed with liquid ink through a corresponding ink flow path isolated from other nozzles of the array by the barrier layer/orifice structure, further comprising printhead electronics that provide firing pulses to the drop generators such that no two nozzles of each nozzle subgroup are fired sequentially.

4. The printhead of claim 3, wherein the printhead electronics provides said firing pulses such that no two nozzles in a nozzle subgroup are activated simultaneously.

5. The printhead of claim 3 wherein the barrier/orifice structure includes a polymer layer.

6. The printhead of claim 3 wherein the nozzles of each nozzle column have a pitch of 600 nozzles per inch (npi).

7. The printhead of claim 3, wherein said ink feed slot is an elongated trench extending along a length of said nozzle columns.

8. A fluid ejecting printhead, comprising:

a substrate having a surface, and a fluid supply slot formed through the substrate to the surface;

a columnar group of drop generators formed on the surface that are arranged into subgroups each comprising at least two drop generators, each of said subgroups supplied with fluid through plurality of fluid feed holes connected to the fluid supply slot to provide fluid to each of the subgroups of drop generators, each subgroup being fluidically isolated from other subgroups on the surface, the columnar group of drop generators arranged in a column transverse to a direction of relative movement between the printhead and a print medium; and printhead electronics that provide firing pulses to the drop generators such that no two drop generators in the same subgroup are activated in sequence.

9. The printhead of claim 8, wherein the printhead electronics activates the drop generators in said columnar group of drop generators one at a time.

10. The printhead of claim 9, wherein the columnar group of drop generators is a primitive, and the substrate comprises a plurality of primitives arranged in a column.

11. The printhead of claim 8, wherein each subgroup includes a chamber and at least two firing resistors.

12. The printhead of claim 8, wherein the substrate includes a thin film layer that overlays the fluid feed slot, the thin film layer defining the fluid feed holes that couple each of the subgroups to the fluid feed slot.

13. The printhead of claim 12, wherein the thin film layer comprises a plurality of thin films, the thin film layer forming heater resistors in each of the drop generators.

14. The printhead of claim 8, further including a fluid supply fluidically coupled to the fluid feed slot to supply the feed slot with fluid.

15. The printhead of claim 14, wherein the fluid supply is a supply of liquid ink.

16. The printhead of claim 8, wherein the subgroups include a pair of drop generators.

17. A system for delivering fluid, comprising:

a printhead substrate having a surface on which is formed a columnar group of drop generators that are arranged into subgroups, each of the subgroups including more than one generator and a plurality of fluid feed holes connected to one or more fluid feed slots formed through the substrate to provide fluid to each of the subgroups of drop generators in the columnar group, the subgroups being fluidically isolated from each other on the surface, the columnar group of drop generators arranged in a column transverse to a direction of relative movement between the printhead and a print medium;

a printhead control electronics electrically coupled to the printhead, the printhead control electronics proving firing signals to the printhead such that no two drop generators in the same subgroup are activated in sequence.

18. The system of claim 17, further comprising an apparatus for imparting relative motion between the printhead substrate and the print media.

19. The system of claim 17, further comprising a fluid source commonly coupled to all of the drop generators in a columnar group through the one or more fluid feed slots.

20. The printhead of claim 17, further including a fluid supply fluidically coupled to the fluid feed slot to supply the feed slot with fluid.

21. The printhead of claim 20, wherein the fluid supply is a supply of liquid ink.

22. The system of claim 17, wherein the subgroups include a pair of drop generators.

23. The system of claim 17, wherein the fluid feed holes are formed in a thin film layer.

24. The printhead of claim 17, wherein the printhead electronics activates the drop generators in said columnar group of drop generators one at a time.

25. The printhead of claim 24, wherein the columnar group of drop generators is a primitive, and the substrate comprises a plurality of primitives arranged in a column.

26. A method of controlling a printhead, comprising:

providing a printhead having a substrate surface with a columnar group of drop generators formed on the surface that are arranged into subgroups each comprising more than one drop generator, the columnar group of drop generators arranged in a column transverse to a direction of relative movement between the printhead and a print medium;

fluidically isolating each subgroup from other subgroups on the surface;

feeding each of the subgroups with fluid through a plurality of fluid feed holes connected to a fluid supply slot formed through the substrate that provide fluid to each of the subgroups of drop generators; and providing electrical signals to the printhead to activate the drop generators to eject fluid drops such that no two drop generators in the same subgroup are activated in sequence.

27. The method of claim 26, further comprising:

providing fluid to the subgroups from a common fluid source through the slot.

28. The method of claim 27, further comprising replacing fluid to the fluid source.

29. The method of claim 28 wherein the fluid is liquid ink.

30. The method of claim 28, wherein feeding fluid to each subgroup comprises providing fluid through fluid feed holes formed in a thin film layer.

31. The method of claim 26, wherein said providing electrical signals to the printhead further activates the drop generators such that no two drop generators in the same subgroup are activated simultaneously.

32. An ink jet printhead comprising:

a substrate;

a thin film structure formed on the substrate and defining printhead circuitry;

a barrier/orifice structure supported by the substrate and defining an array of nozzles arranged in a plurality of nozzle columns and an array of firing chambers in correspondence with correspondence with the array of nozzles, the nozzles columns arranged transverse to a direction of relative movement between the printhead and a print medium;

the nozzles comprising each column of the array arranged in subgroups of nozzles, each subgroup comprising at least two nozzles, each subgroup fed with liquid ink through a corresponding ink flow path isolated from other nozzles of the array by the barrier layer/orifice structure, wherein the ink flow path for each nozzle subgroup includes a plurality of fluid feed holes formed in the substrate, and wherein each nozzle of a nozzle subgroup is supplied with ink via said plurality of fluid feed holes.

33. The printhead of claim 32, further comprising printhead electronics that provide firing pulses to the drop generators such that no two nozzles of each nozzle subgroup are fired in sequence.

34. The printhead of claim 33, wherein the printhead electronics provides said firing pulses such that no two nozzles in a nozzle subgroup are activated simultaneously.

35. The printhead of claim 32 wherein the barrier/orifice structure includes a polymer layer.

36. The printhead of claim 32 wherein the nozzles of each nozzle column have a pitch of 600 nozzles per inch (npi).

37. An ink jet printhead comprising:

a substrate having an ink feed slot formed therein;

a thin film layer disposed on a surface of the substrate, the thin film layer defining a plurality of firing resistors, the thin film layer having a plurality of ink feed openings formed through to provide respective ink paths through the ink feed slot and thin film layer;

a barrier/orifice structure disposed on the thin film layer, the structure defining an array of nozzles arranged in a plurality of nozzle columns and an array of firing chambers in correspondence with correspondence with the array of nozzles, the nozzles comprising each of said plurality of nozzle columns of the array are arranged in subgroups of nozzles, each subgroup comprising at least two nozzles, each sub-group fed with liquid ink through a corresponding ink flow path isolated from other nozzles of the array by the barrier layer/orifice structure;

the firing resistors being arranged in correspondence with the firing chambers;

the barrier/orifice structure further comprising a continuous rib portion extending between adjacent first and second ones of the plurality of nozzle columns and over said ink feed slot to fluidically separate the first and second ones of the nozzle columns.

38. The printhead of claim 37 wherein said plurality of ink feed openings are arranged in a first group on a first side of said rib portion for feeding nozzles of the first one of said plurality of columns, and a second group on a second side of said rib portion for feeding nozzles of the second one of said plurality of columns.

39. The printhead of claim 37, wherein said ink feed slot is an elongated trench extending along a length of said nozzle columns.

* * * * *

UNITED STATES PATENT AND TRADEMARK OFFICE

CERTIFICATE OF CORRECTION

PATENT NO. : 6,922,203 B2
APPLICATION NO. : 09/876506
DATED : July 26, 2005
INVENTOR(S) : Matthew D. Giere et al.

It is certified that error appears in the above-identified patent and that said Letters Patent is hereby corrected as shown below:

In column 14, line 65, in Claim 8, after “through” insert -- a --.

In column 15, line 34, in Claim 17, after “one” insert -- drop --.

Signed and Sealed this

Twenty-first Day of July, 2009

JOHN DOLL
*Acting Director of the United States Patent and Trademark Office*